US005542875A

United States Patent [19]

Ichiguchi

[11] Patent Number: 5,542,875

[45] Date of Patent: Aug. 6, 1996

[54] ABRASIVE WHEEL

[76] Inventor: Hirokazu Ichiguchi, 1984-37, Nakatomigaoka 2-chome, Nara-shi, Nara, Japan

[21] Appl. No.: 198,776

[22] Filed: Feb. 18, 1994

[30] Foreign Application Priority Data

Feb. 9, 1993 [JP] Japan ..... 5-005527 U
Oct. 29, 1993 [JP] Japan ..... 5-058597 U

[51] Int. Cl.[6] ..... B24D 13/14

[52] U.S. Cl. ..... 451/533; 451/538; 451/548; 451/544

[58] Field of Search ..... 451/533, 534, 451/536, 537, 538, 544, 548, 527, 465, 464, 463, 490, 528, 529, 449, 488, 539, 921; 51/297

[56] References Cited

U.S. PATENT DOCUMENTS 2,746,216 5/1956 Hollingsworth ..... 451/526
2,771,722 11/1956 Field ..... 451/527
2,815,617 12/1957 Bernstein ..... 451/529
2,871,633 2/1959 Klingspor ..... 451/544
3,653,858 4/1972 Field ..... 451/538
5,125,192 6/1992 Welsch ..... 451/538

FOREIGN PATENT DOCUMENTS 3-234476 10/1991 Japan ..... 451/526
0621795 4/1949 United Kingdom ..... 451/544

*Primary Examiner*—Robert A. Rose
*Attorney, Agent, or Firm*—Wenderoth, Lind & Ponack

[57] ABSTRACT

A ring-shaped abrasive member is formed of a plurality of sheets of abrasive cloth paper laminated and bonded together. The abrasive member is formed with a plurality of cuts so as to extend inwardly from its outer edge or extend outwardly from its inner edge. On the back of the abrasive member is secured a wheel substrate together with adhesive. The abrasive member is pressed against a workpiece while rotating the abrasive member to abrade the workpiece. The powdery debris and abrasive grains trapped in the cuts will move toward the outer periphery of the abrasive member and be discharged from the outer ends of the cuts. When the topmost abrasive sheet forming the abrasive member gets worn out, the sheet thereunder will be exposed.

15 Claims, 5 Drawing Sheets

ABRASIVE WHEEL

BACKGROUND OF THE INVENTION

This invention relates to an abrasive wheel comprising an abrasive member made from a plurality of abrasive-coated cloth papers and a wheel substrate.

An abrasive wheel of this type is disclosed in Examined Japanese Utility Model Publication 1-114273. This abrasive wheel comprises a substrate (disk) and a plurality of sheets of abrasive-coated cloth paper having abrasive grains bonded to theist surfaces and bonded to the substrate so as to be arranged radially. The sheets of abrasive-coated cloth paper may be fixed to the substrate radially or in an inclined state with respect to the substrate surface.

This type of abrasive wheel is mounted on the rotary shaft of a hand grinder. When in use, the sheets of abrasive-coated paper are pressed against a workpiece while rotating the wheel to abrade the workpiece.

When pressed against a workpiece, the sheets of abrasive-coated cloth paper are inclined in the direction opposite to the direction of rotation of the disk. At the corner portions of the workpiece, the inclined pieces tend to erect due to their own resilience since they are bonded at only one end thereof, so that they are pressed hard against the corner portions of the workpiece. Thus, the corners of the workpiece are like to be rounded off.

When abrading a weld bead, the sheets of abrasive-coated cloth paper tend to be pressed not only against the weld bead but against a welded portion due to their resilience, thereby abrading the welded portion.

Further, any abrasive powder or grains that separate from the pieces of abrasive material while abrading will be trapped between the subsequent pieces of abrasive material and the workpiece. Thus, the sheets of abrasive-coated cloth paper are likely to clog with such abrasive powder and grains. This markedly deteriorates the abrading efficiency.

Moreover, since the sheets of abrasive-coated cloth paper have to be arranged radially and bonded one by one with adhesive to the substrate, it was extremely troublesome to manufacture such an abrasive wheel. Thus, its mass-productivity was low and its cost extremely high.

SUMMARY OF THE INVENTION

It is an object of this invention to provide an abrasive wheel which will not round off a corner portion of a workpiece, which does not abrade a portion of a workpiece not intended to abrade or the boundary between a portion of the workpiece to be abraded and a portion not to be abraded, which shows a high abrading efficiency, and which can be mass-produced economically.

According to this invention, there is provided an abrasive wheel comprising an abrasive member having a plurality of ring-shaped sheets of abrasive-coated cloth paper which are laminated and bonded together, and a wheel substrate bonded to one side of the abrasive member.

According to the present invention, the abrasive member should be formed with a plurality of cuts that extend inwardly from its outer peripheral surface and terminate short of its inner peripheral surface, or which extend outwardly from its inner peripheral surface and terminate short of its outer peripheral surface, or which are disposed between its inner and outer edges, and short of both inner and outer edges thereof.

The wheel substrate of the abrasive wheel is mounted on the rotary shaft of a hand grinder. The abrasive member is pressed against a workpiece while rotating the abrasive member to abrade (grind) the workpiece.

Fine powdery debris of the workpiece produced during abrading and abrasive grains separated from the abrasive member will fall into the cuts formed in the abrasive member. Thus, as shown in the drawing figures, each of the cuts is defined by a groove which can accommodate the powdery debris and abrasive grains.

The powdery debris and abrasive grains in the cuts will move toward the outer periphery of the abrasive member due to the centrifugal force produced by the rotating abrasive wheel and be discharged from the outer ends of the cuts. Thus, the abrasive member is much less likely to clog and the abrading efficiency improves dramatically.

When the topmost abrasive sheet forming the abrasive member gets worn out, the sheet thereunder will be exposed. Thus, the abrasive member can maintain its abrading capacity for a long time and show a long service life.

When abrading a workpiece, the abrasive member is pressed against the workpiece along its outer edge. Thus, the abrasive member is worn along its outer edge, so that the outer ends of the cuts will open. The powdery debris and abrasive grains trapped in the cuts are thus discharged from their outer ends.

Since the abrasive member is formed of a plurality of sheets of abrasive cloth paper laminated and bonded together, they are less like to round off a corner portion of a workpiece, or to abrade a portion of a workpiece not intended to be abraded at the boundary between such a portion and a portion to be abraded, when compared with a conventional abrasive member comprising a plurality of radially arranged pieces of abrasive cloth paper. Also, the abrasive member of this invention is less likely to chatter.

By pressing the abrasive member against a workpiece, the top sheet of abrasive cloth paper comes into contact over its entire surface with a workpiece, so that the abrasive sheet can fully reveal its properties.

Since each abrasive sheet is not divided into separate members by the cuts, it is easy to laminate and bond together a plurality of such sheets or to bond them to the wheel substrate. The abrasive wheel thus formed can be mass-produced at low cost.

The connecting portions provided between the inner ends of the cuts and the inner edge of the abrasive wheel make the abrasive wheel highly resistant to centrifugal force and shock.

BRIEF DESCRIPTION OF THE DRAWING

Other features and objects of the present invention will become apparent from the following description made with reference to the accompanying drawings, in which.

DETAILED DESCRIPTION OF THE INVENTION

Now, the embodiments of this invention will be described with reference to the accompanying drawings.

(First Embodiment)

Figure 1:
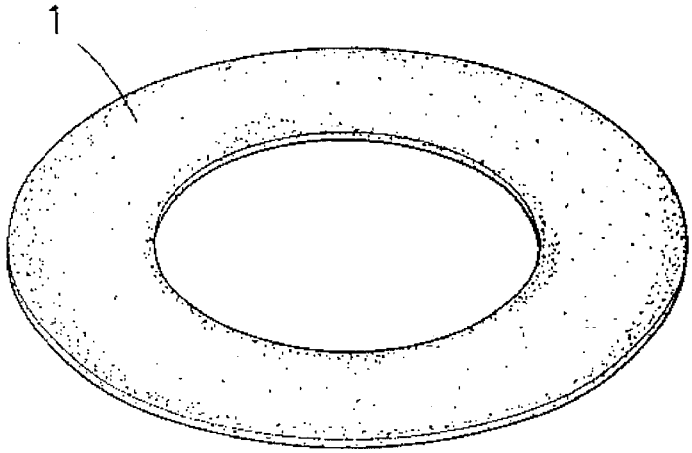
FIG. 1 is a perspective view of a sheet of abrasive paper cloth of a first embodiment according to this invention.
Figure 2:
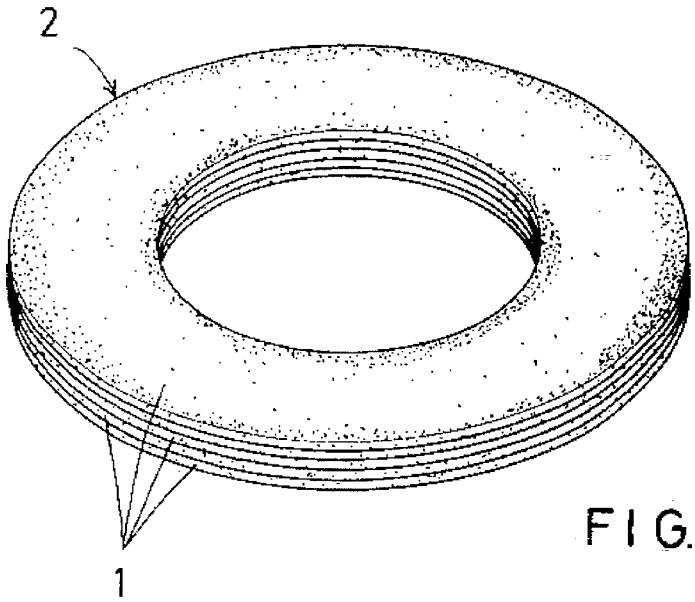
FIG. 2 is a perspective view of an abrasive member made up of a plurality of the sheets of FIG. 1.

A plurality of doughnut-shaped sheets of abrasive-coated cloth paper 1 shown in FIG. 1 are laminated as shown in FIG. 2 and bonded together to form a ring-shaped abrasive member 2.

Figure 3:
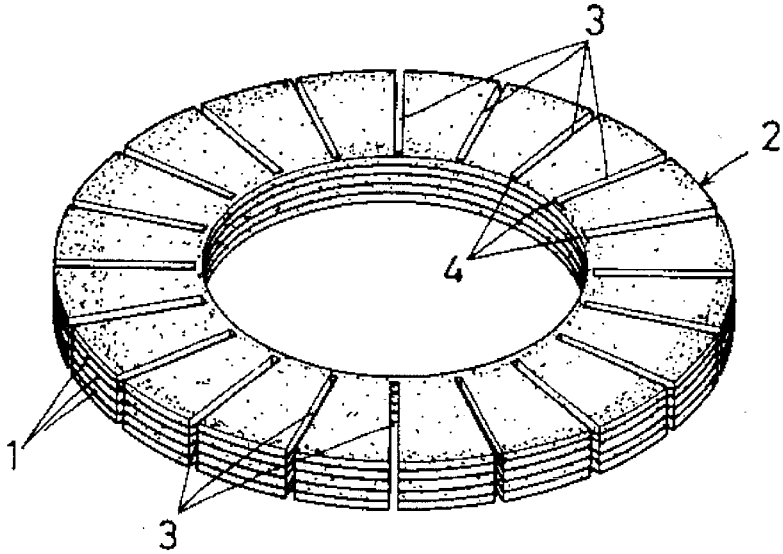
FIG. 3 is a perspective view of the first embodiment.

As shown in FIG. 3, the abrasive member 2 is formed with a plurality of cuts or grooves 3 which extend radially inwardly from its outer periphery and terminate just short of its inner peripheral surface.

Connecting portions 4 are provided between the inner ends of the cuts 3 and the inner peripheral surface of the abrasive member 2.

In the embodiment shown, the plurality of doughnut-shaped abrasive sheets 1 are laminated and bonded together with adhesive so that their abrasive-coated sides will face the same direction (i.e. forwardly of the abrasive wheel). The cuts 3 are formed thereafter. But the doughnut-shaped abrasive sheets 1 may be formed by blanking the cloth paper so as to form the cuts 3. The sheets 1 thus formed are laminated and bonded together so that their cuts 3 will align with one another. Otherwise, the doughnut-shaped abrasive member 2 may be formed by laminating a plurality of abrasive-coated sheets which are larger than the sheets 1, bonding them together with adhesive and blanking them to the shape of the sheets 1 having cuts 3.

Figure 4:
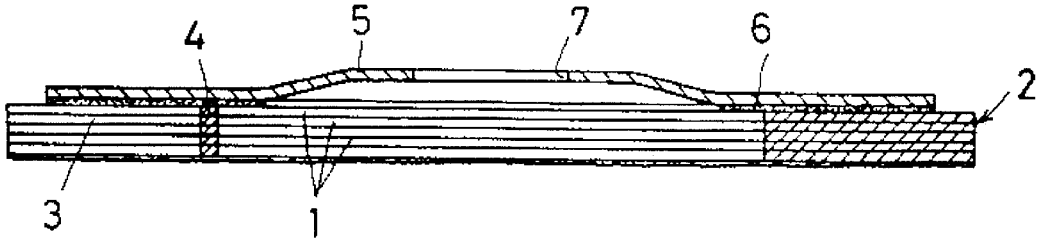
FIG. 4 is a vertical sectional front view of the abrasive member of FIG. 3 bonded to the wheel substrate.

As shown in FIG. 4, the abrasive member 2 thus formed is bonded to the surface of a wheel substrate 5 with an adhesive 6.

In the embodiment shown, the abrasive member 2 is secured to the wheel substrate 5 so that the outer circumferential of the abrasive member 2 edge protrudes from the outer edge of the substrate 5. In this arrangement, the outer edge of the abrasive member 2 is used to abrade a workpiece.

(Second Embodiment)

Figure 5:
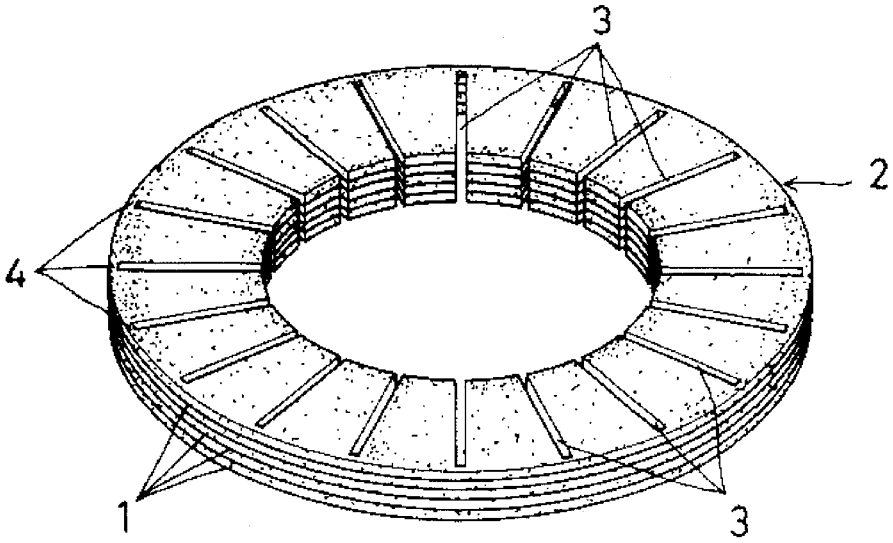
FIG. 5 is a perspective view of an abrasive member of a second embodiment.
Figure 6:
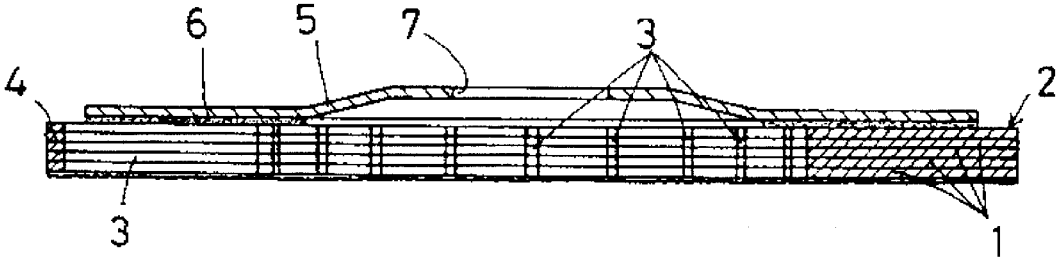
FIG. 6 is a vertical sectional front view of the abrasive member of FIG. 5 bonded to the wheel substrate.

As shown in FIGS. 5 and 6, the abrasive member 2 is formed with cuts 3 which extend radially outwardly from its inner peripheral surface and terminate just short of its outer peripheral surface. Connecting portions 4 are provided between the outer ends of the respective cuts 3 and the outer peripheral surface of the abrasive member 2.

The member 2 of this embodiment may be manufactured in the same manner as in the first embodiment.

(Third Embodiment)

Figure 7:
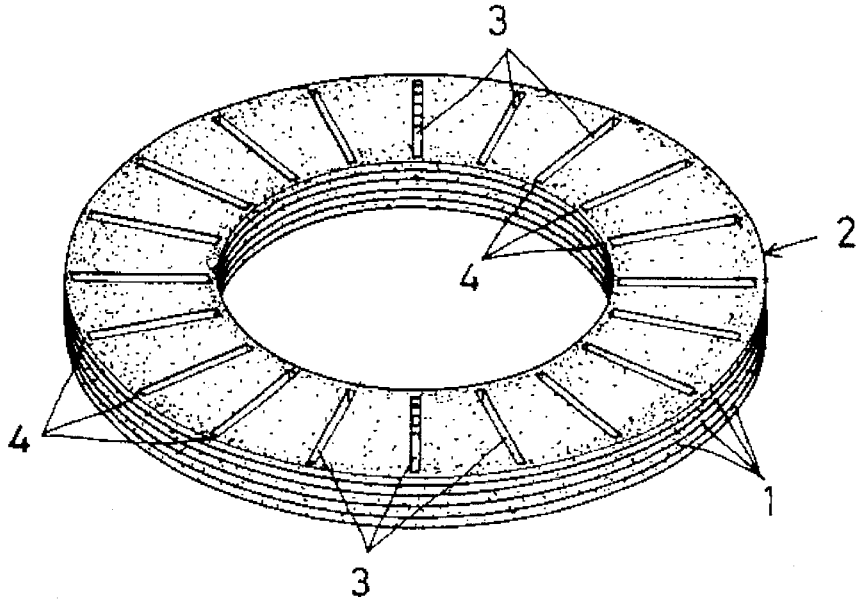
FIG. 7 is a perspective view of an abrasive member of a third embodiment.
Figure 8:
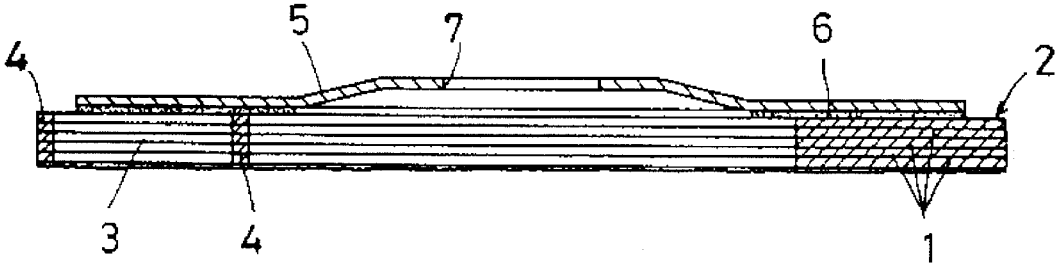
FIG. 8 is a vertical sectional front view of the abrasive member of FIG. 7 bonded to the wheel substrate.

As shown in FIG. 7 and 8, the abrasive member 2 is formed with cuts 3 which extend radially so as to be disposed between its inner and outer edges. Connecting portions 4 are provided between the inner ends of the cuts 3 and the inner peripheral surface of the member 2 and between the outer ends of the cuts 3 and the outer peripheral surface of the member 2.

The member 2 of this embodiment may be manufactured in the same manner as in the first embodiment.

Numeral 7 designates a hole formed in the center of the wheel substrate 5 through which is inserted the rotary shaft of a hand grinder.

(Fourth Embodiment)

Figure 9:
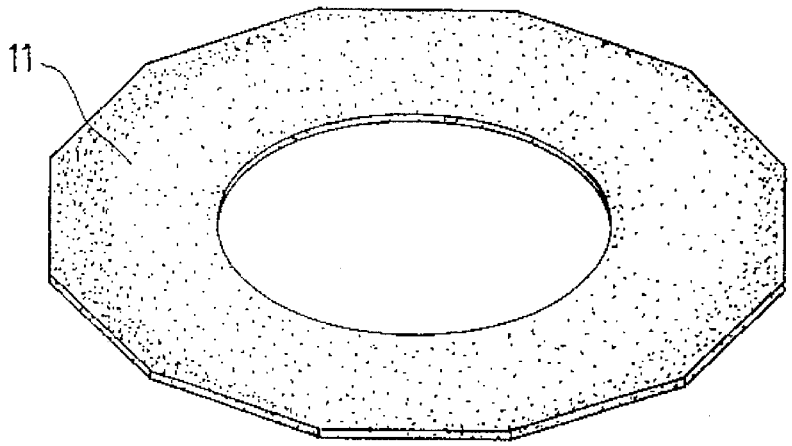
FIG. 9 is a perspective view of a sheet of abrasive cloth paper of a fourth embodiment.
Figure 10:
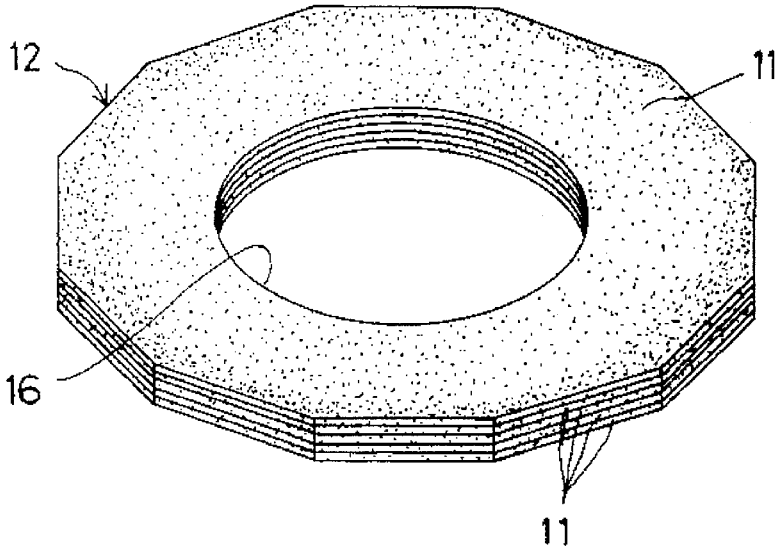
FIG. 10 is a perspective view of an abrasive member formed by laminating a plurality of the sheets of FIG. 9.
Figure 11:
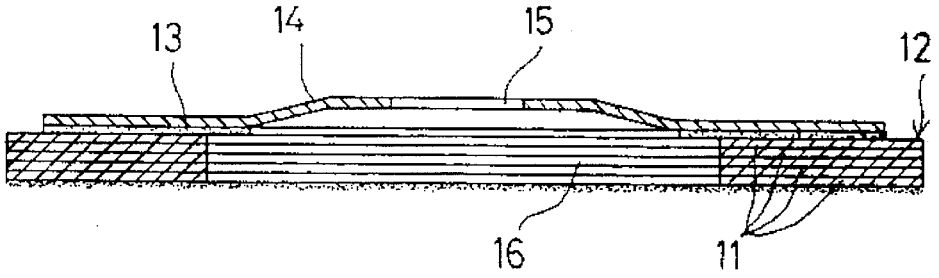
FIG. 11 is a vertical sectional front view of the fourth embodiment having the abrasive member of FIG. 10.

A plurality of sheets of abrasive-coated cloth paper 11 having a polygonal outer edge as shown in FIG. 9 are laminated and bonded together to form an abrasive member 12 as shown in FIG, 10.

The sheets 11 are laminated so that their abrasive-coated sides will face the front of the member 12 and bonded together with adhesive (not shown).

On the back of the abrasive member 12 is secured a wheel substrate, 4 with an adhesive 3.

The abrasive member 12 has its outer edge protruding from the outer edge of the wheel substrate 4. This outer polygonal edge is used to abrade or grind a workpiece.

In the embodiment shown, the wheel substrate 4 is formed with a central hole 5 while each abrasive-coated sheet 11 is formed with a central hole 6. The mounting bracket of a hand grinder is inserted through the holes 5 and 6.

It is not necessary to form the hole 6 in the abrasive sheets 11 if the wheel substrate 4 has a shaft (not shown) which can be clamped by a chuck on its surface opposite to the surface on which is mounted the abrasive member 12.

The number of corners of the polygonal outer edge of each abrasive-coated sheet 11 is not limited to twelve as shown.

Figure 12:
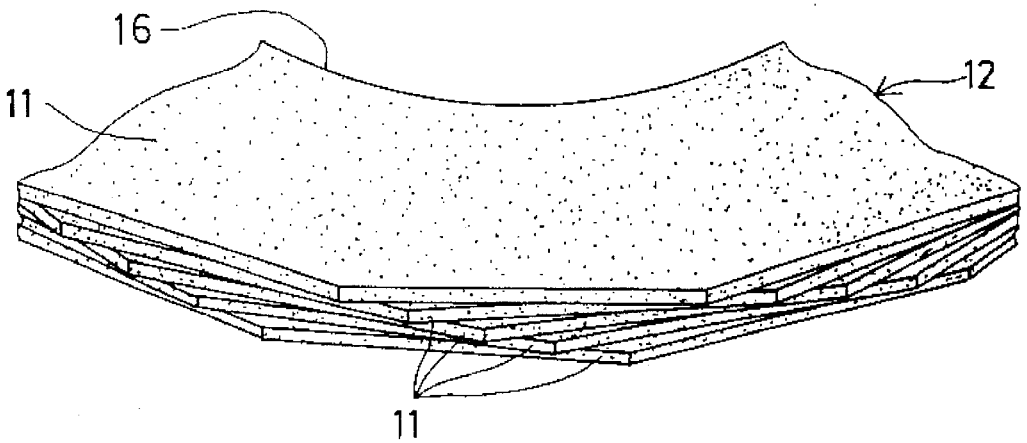
FIG. 12 is a perspective view of an abrasive member formed by laminating the abrasive sheets in a different manner.
Figure 13:
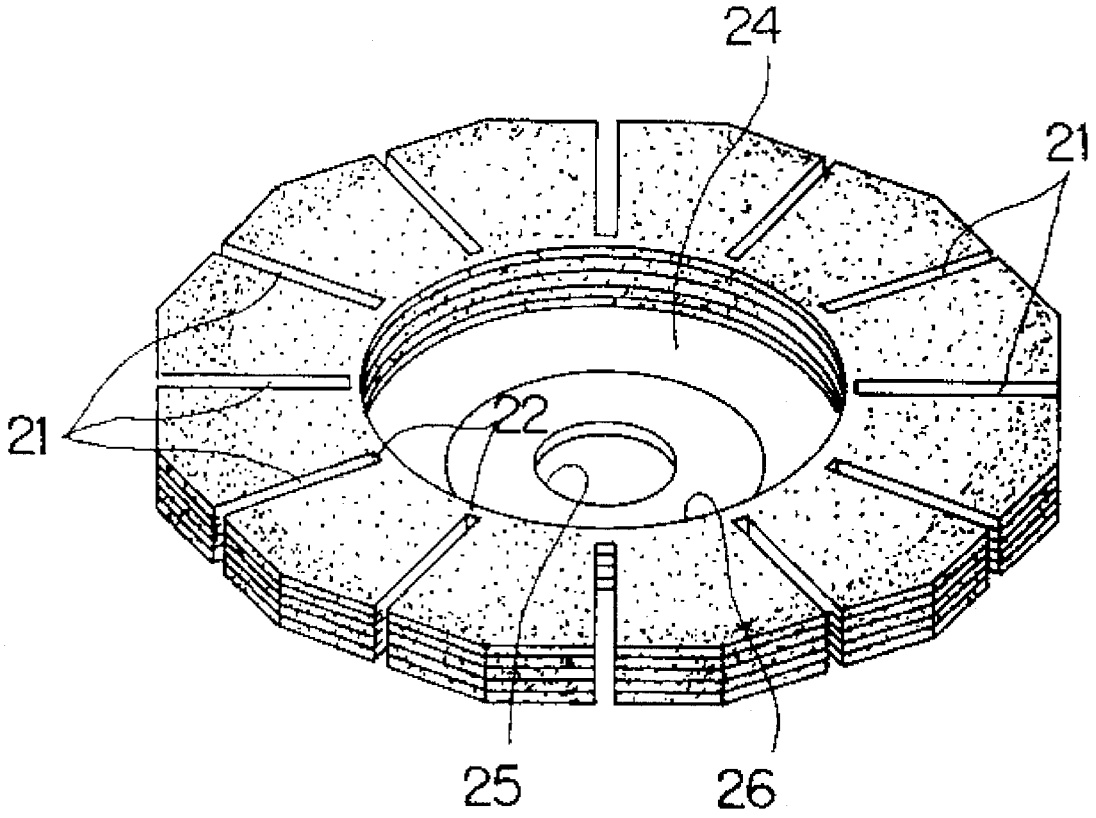
FIG. 13 is a perspective view of a fifth embodiment.

In the embodiment shown in FIG, 10, the abrasive sheets 11 are laminated so that their corner portions will align vertically with one another. But they may be laminated so that their corner portions are offset in the direction of rotation as shown in FIG. 12.

(Fifth Embodiment)

The abrasive member is formed with a plurality of cuts 21 that extend radially inwards from its outer peripheral surface. Otherwise, this embodiment is the same as the fourth embodiment.

The cuts 21 may be formed before laminating the abrasive sheets. In this case, the sheets are laminated so that their cuts will align with one another, Otherwise, the cuts may be formed in the abrasive member. If the abrasive member has a through hole 26, the cuts are formed so as to terminate just short of the hole 26 to provide connecting portions (such connecting portion may be provided in the sheets of abrasive-coated cloth paper forming the wheel substrate 24. The segments of the abrasive member divided by the cuts are thus connected together through the connecting portions.

In the embodiment shown, the cuts are formed between the adjacent corners of the polygonal outer edge. But they may be formed at the corners.

The polygonal outer edge of the abrasive member may be formed by blanking the abrasive sheets 1 before forming them into the abrasive member or such polygonal outer edge may be formed after forming the abrasive member.

What is claimed is:

1. An abrasive wheel comprising:

an abrasive member having a plurality of ring-shaped sheets of abrasive-coated cloth paper which are laminated and bonded together;

a wheel substrate bonded to one side of said abrasive member;

wherein said abrasive member is formed with a plurality of cuts extending radially; and wherein each of said cuts extends outwardly from an inner edge of said abrasive member and terminates short of an outer edge of said abrasive member.

2. An abrasive wheel comprising:

an abrasive member having a plurality of ring-shaped sheets of abrasive-coated cloth paper which are laminated and bonded together;

a wheel substrate bonded to one side of said abrasive member;

wherein said abrasive member is formed with a plurality of cuts extending radially; and wherein each of said cuts extends radially short of both inner and outer edges of said abrasive member.

3. An abrasive wheel as recited in claim 1, wherein each of said ring-shaped sheets has a circular outer edge.

4. An abrasive wheel as recited in claim 1, wherein each of said ring-shaped sheets has a polygonal outer edge.

5. An abrasive wheel as recited in claim 2, wherein each of said ring-shaped sheets has a circular outer edge.

6. An abrasive wheel as recited in claim 2, wherein each of said ring-shaped sheets has a polygonal outer edge.

7. An abrasive wheel comprising:

an abrasive member having a plurality of ring-shaped sheets of abrasive-coated cloth paper which are laminated and bonded together;

a wheel substrate bonded to one side of said abrasive member; and wherein said abrasive member is formed with a plurality of radially extending grooves constituting means for accommodating powdery debris and abrasive grains therein.

8. An abrasive wheel as recited in claim 7, wherein each of said grooves extends inwardly from an inner edge of said abrasive member and terminates short of an outer edge of said abrasive member.

9. An abrasive wheel as recited in claim 8 wherein each of said ring-shaped sheets has a circular outer edge.

10. An abrasive wheel as recited in claim 8, wherein each of said ring-shaped sheets has a polygonal outer edge.

11. An abrasive wheel as recited in claim 7, wherein each of said ring-shaped sheets has a circular outer edge.

12. An abrasive wheel as recited in claim 7, wherein each of said ring-shaped sheets has a polygonal outer edge.

13. An abrasive wheel as recited in claim 7, wherein each of said grooves extends radially short of both inner and outer edges of said abrasive member.

14. An abrasive wheel as recited in claim 13, wherein each of said ring-shaped sheets has a circular outer edge.

15. An abrasive wheel as recited in claim 13, wherein each of said ring-shaped sheets has a polygonal outer edge.

* * * * *